US011532900B2

(12) United States Patent
Hansen et al.

(10) Patent No.: US 11,532,900 B2
(45) Date of Patent: Dec. 20, 2022

(54) COAXIAL CABLE CONNECTOR ASSEMBLIES HAVING REAR BODY RETENTION MEMBERS AND METHODS FOR USING THE SAME

(71) Applicant: CORNING OPTICAL COMMUNICATIONS RF LLC, Glendale, AZ (US)

(72) Inventors: Jorgen Mitchell Hansen, Tempe, AZ (US); Brian Lyle Kisling, Youngtown, AZ (US); David Jeffrey Malouf, Surprise, AZ (US)

(73) Assignee: CORNING OPTICAL COMMUNICATIONS RF LLC, Glendale, AZ (US)

( * ) Notice: Subject to any disclaimer, the term of this patent is extended or adjusted under 35 U.S.C. 154(b) by 34 days.

(21) Appl. No.: 17/327,529

(22) Filed: May 21, 2021

(65) Prior Publication Data

US 2021/0376501 A1 Dec. 2, 2021

Related U.S. Application Data

(60) Provisional application No. 63/031,235, filed on May 28, 2020.

(51) Int. Cl.

| | |
|---|---|
| ***H01R 9/05*** | (2006.01) |
| ***H01R 24/56*** | (2011.01) |
| ***H01R 103/00*** | (2006.01) |

(52) U.S. Cl.

CPC ..... *H01R 9/0521* (2013.01); *H01R 24/56* (2013.01); *H01R 2103/00* (2013.01)

(58) Field of Classification Search

CPC ... H01R 2103/00; H01R 24/56; H01R 9/0521

See application file for complete search history.

(56) References Cited

U.S. PATENT DOCUMENTS 5,368,283 A 11/1994 Pavlin
7,108,547 B2 * 9/2006 Kisling ..... H01R 9/0524 439/578
7,828,594 B2 11/2010 Burris et al.
(Continued)

FOREIGN PATENT DOCUMENTS

CA 2888475 A1 4/2014

*Primary Examiner* — Briggitte R. Hammond
(74) *Attorney, Agent, or Firm* — Tamika A. Crawl-Bey

(57) ABSTRACT

A coaxial cable connector assembly includes a coupler, a rear body assembly rotatably engaged with the coupler, the rear body assembly including a stationary retention member defining an stationary retention member inner channel surface and one or more stationary retention member grooves extending inwardly from the stationary retention member inner channel surface, a movable retention member that is movable with respect to the stationary retention member in an axial direction, the movable retention member defining a movable retention member inner channel surface and one or more movable retention member grooves extending inwardly from the movable retention member inner channel surface, the one or more movable retention member grooves defining a movable retention member groove surface, and one or more compression rings positioned at least partially within the one or more stationary retention member grooves.

20 Claims, 7 Drawing Sheets

(56) References Cited

U.S. PATENT DOCUMENTS

| | | | | |
|---|---|---|---|---|
| 7,927,135 | B1 | 4/2011 | Wlos | |
| 8,393,919 | B2 | 3/2013 | Islam et al. | |
| 9,172,156 | B2 * | 10/2015 | Nugent | H01R 43/00 |

* cited by examiner

COAXIAL CABLE CONNECTOR ASSEMBLIES HAVING REAR BODY RETENTION MEMBERS AND METHODS FOR USING THE SAME

CROSS-REFERENCE TO RELATED APPLICATIONS

This application claims the benefit of priority under 35 U.S.C. § 119 of U.S. Provisional Application Ser. No. 63/031,235, filed May 28, 2020, the content of which is relied upon and incorporated herein by reference in its entirety.

BACKGROUND

The present disclosure relates to coaxial cable connector assemblies, and more particularly to coaxial cable connector assemblies having rear body retention members and methods for using coaxial cable connector assemblies having rear body retention members.

Coaxial cable connector assemblies, such as F-type connectors, are conventionally used to connect a coaxial cable to a device, such as a television or the like. Coaxial cables generally include an inner conductor and an outer conductor extending around the inner conductor. In some configurations, signals are transmitted through the inner conductor, and the outer conductor may be maintained at earth potential.

BRIEF SUMMARY

In some instances, it may be difficult for a user, such as an installation technician, to couple the coaxial cable to the coaxial cable connector assembly. For example, some conventional coaxial cable connector assemblies may be coupled to a coaxial cable through the deformation of components of the coaxial cable connector assembly. However, it may require significant force to deform components of the coaxial cable connector assemblies and the use of cumbersome tools may be required. Accordingly, a need exists for coaxial cable connector assemblies with improved rear bodies that can be coupled to a coaxial cable.

In a first aspect A1, the present disclosure provides a coaxial cable connector assembly including a coupler, a rear body assembly rotatably engaged with the coupler, the rear body assembly including a stationary retention member defining a stationary retention member inner channel surface and one or more stationary retention member grooves extending inwardly from the stationary retention member inner channel surface, a movable retention member that is movable with respect to the stationary retention member in an axial direction, the movable retention member defining a movable retention member inner channel surface and one or more movable retention member grooves extending inwardly from the movable retention member inner channel surface, the one or more movable retention member grooves defining a movable retention member groove surface, and one or more compression rings positioned at least partially within the one or more stationary retention member grooves.

In a second aspect A2, the present disclosure provides the coaxial cable connector assembly of aspect A1, where the coupler includes a thread at a front portion of the coupler structurally configured to couple the coaxial cable connector assembly to a port of a device.

In a third aspect A3, the present disclosure provides the coaxial cable connector assembly of either of aspects A1 or A2, where the movable retention member includes a cable engagement surface structurally configured to engage a coaxial cable inserted into the coaxial cable connector assembly in an advancing direction.

In a fourth aspect A4, the present disclosure provides the coaxial cable connector assembly of any of aspects A1-A3, where the one or more compression rings are positionable between an engaged position, in which the one or more compression rings define an engaged inner span, and a disengaged position, in which the one or more compression rings define a disengaged inner span, and where the engaged inner span is less than the disengaged inner span.

In a fifth aspect A5, the present disclosure provides the coaxial cable connector assembly of aspect A4, where the movable retention member is positionable from a disengaged position, in which the movable retention member retains the one or more compression rings in the disengaged position, to an engaged position, in which the movable retention member releases the one or more compression rings into the engaged position.

In a sixth aspect A6, the present disclosure provides the coaxial cable connector assembly of either of aspects A4 or A5, where the movable retention member defines a compression ring engagement face, and where the movable retention member is positionable from a disengaged position, in which the compression ring engagement face is engaged with the one or more compression rings, to an engaged position in which the compression ring engagement face is spaced apart from the one or more compression rings.

In a seventh aspect A7, the present disclosure provides the coaxial cable connector assembly of any of aspects A1-A6, where the movable retention member defines a movable retention member tapered surface extending between the movable retention member inner channel surface and the movable retention member groove surface.

In an eighth aspect A8, the present disclosure provides the coaxial cable connector assembly of aspect A7, where the movable retention member is positionable from a disengaged position, in which the one or more compression rings are engaged with the movable retention member groove surface, to an engaged position, in which the one or more compression rings are engaged with the movable retention member tapered surface.

In a ninth aspect A9, the present disclosure provides the coaxial cable connector assembly of any of aspects A1-A8, where the one or more stationary retention member grooves define a stationary retention member groove surface positioned outward of the stationary retention member inner channel surface of the stationary retention member and a stationary retention member tapered surface extending between the stationary retention member inner channel surface and the stationary retention member groove surface.

In a tenth aspect A10, the present disclosure provides the coaxial cable connector assembly of aspect A9, where the movable retention member is positionable from a disengaged position, in which the one or more compression rings are engaged with the stationary retention member groove surface, to an engaged position, in which the movable retention member moves the one or more compression rings to engage the stationary retention member tapered surface.

In an eleventh aspect A11, the present disclosure provides the coaxial cable connector assembly of any of aspects A1-A10, where the one or more compression rings define a c-shape.

In a twelfth aspect A12, the present disclosure provides the coaxial cable connector assembly of any of aspects A1-A11, where the one or more compression rings include one or more inwardly-extending teeth structurally configured to engage an outer jacket of a coaxial cable to couple the coaxial cable connector assembly to the coaxial cable.

In a thirteenth aspect A13, the present disclosure provides the coaxial cable connector assembly of any of aspects A1-A12, where the rear body assembly further includes an outer housing defining a housing channel, and where the movable retention member and the stationary retention member are positioned at least partially within the housing channel of the outer housing.

In a fourteenth aspect A14, the present disclosure provides a method for coupling a coaxial cable to a coaxial cable connector assembly, the method including inserting a coaxial cable into a rear body assembly of a coaxial cable connector assembly, the coaxial cable including an inner conductor and an outer jacket surrounding the inner conductor, and where the coaxial cable connector assembly includes the rear body assembly and a coupler rotatably engaged with the rear body assembly, engaging a movable retention member of the rear body assembly with the coaxial cable, moving the movable retention member in an advancing direction with respect to a stationary retention member of the rear body assembly, the stationary retention member defining a stationary retention member inner channel surface and one or more stationary retention member grooves extending inwardly from the stationary retention member inner channel surface, and the rear body assembly further including one or more compression rings positioned at least partially within the one or more stationary retention member grooves, and engaging the outer jacket of the coaxial cable with the one or more compression rings, thereby coupling the coaxial cable to the coaxial cable connector assembly.

In a fifteenth aspect A15, the present disclosure provides the method of aspect A14, where engaging the outer jacket of the coaxial cable with the one or more compression rings includes engaging at least one of a movable retention member tapered surface of the movable retention member and a stationary retention member tapered surface of the stationary retention member with the one or more compression rings.

In a sixteenth aspect A16, the present disclosure provides the method of aspect A15, where engaging the outer jacket of the coaxial cable with the one or more compression rings includes engaging the movable retention member tapered surface of the movable retention member with the one or more compression rings.

In a seventeenth aspect A17, the present disclosure provides the method of either of aspects any of aspects A14-A16, where engaging the outer jacket of the coaxial cable with the one or more compression rings includes disengaging a compression ring engagement face of the movable retention member from the one or more compression rings.

In an eighteenth aspect A18, the present disclosure provides the method of any of aspects A14-A17, where engaging the outer jacket of the coaxial cable with the one or more compression rings includes engaging inwardly-facing teeth of the one or more compression rings with the outer jacket of the coaxial cable.

In a nineteenth aspect A19, the present disclosure provides the method of any of aspects A14-A18, where engaging the movable retention member with the coaxial cable includes engaging the coaxial cable with a cable engagement surface of the movable retention member.

In a twentieth aspect A20, the present disclosure provides the method of any of aspects A14-A19, further including engaging a thread of the coupler of the coaxial cable connector assembly with a corresponding thread of a port device.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments described herein are generally directed to coaxial cable connector assemblies including retention members that can be coupled to a coaxial cable. Coaxial cable connector assemblies, according to embodiments described herein generally include a rear body assembly including one or more compression rings that can be moved from a disengaged position to an engaged position as the coaxial cable is inserted into the coaxial cable connector assembly. The one or more compression rings may engage the coaxial cable in the engaged position, thereby coupling the coaxial cable to the coaxial cable connector assembly. These and other embodiments will now be described with reference to the appended drawings.

Figure 1:
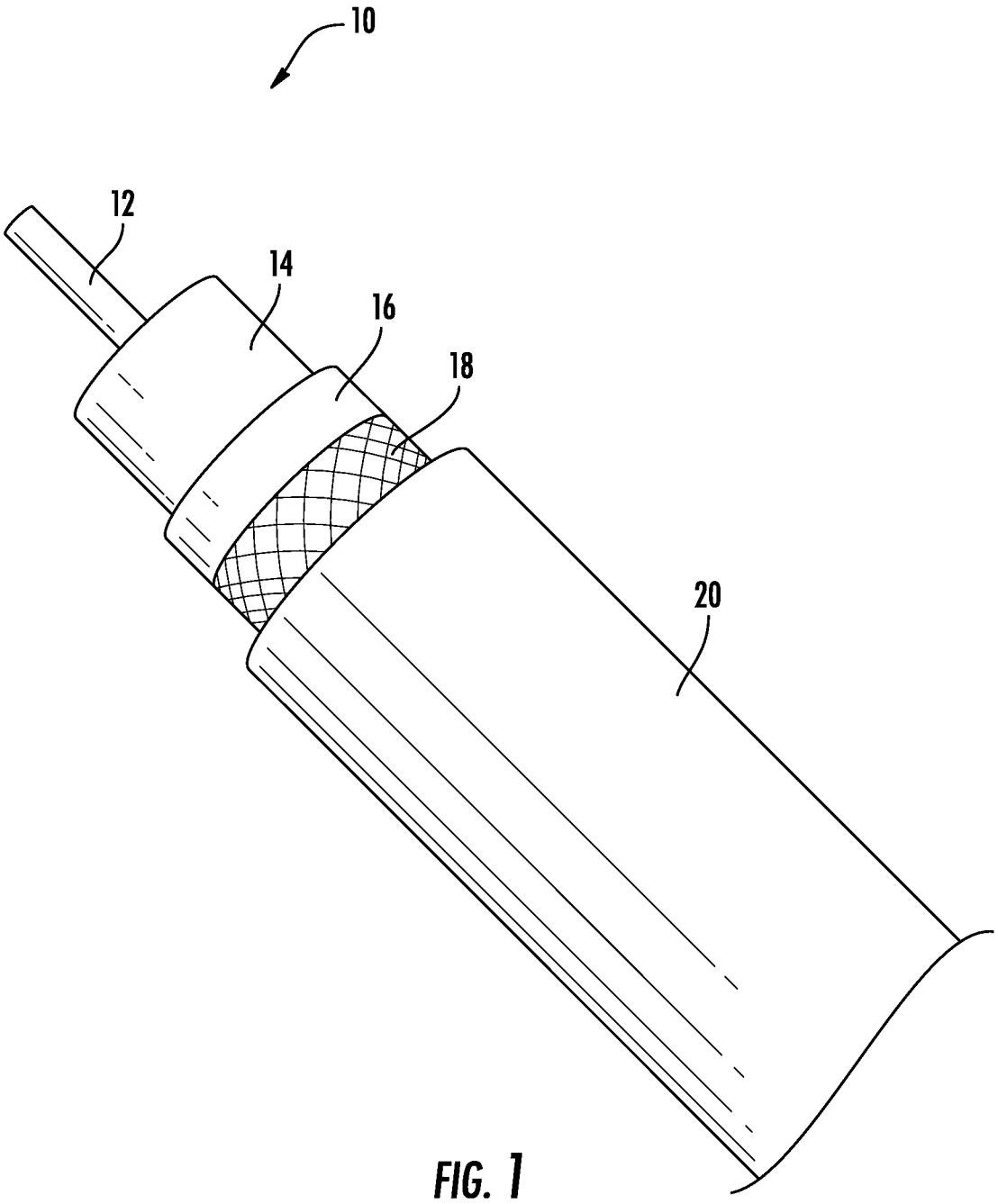
FIG. 1 schematically depicts a perspective view of a coaxial cable, according to one or more embodiments shown and described herein.

Now referring to FIG. 1, a perspective view of a coaxial cable 10 is schematically depicted. The coaxial cable 10 generally includes an inner conductor 12 surrounded by a dielectric material 14. In embodiments, electrical signals may be passed through the inner conductor 12, such as to a device connected to the coaxial cable 10, and the inner conductor 12 may be formed of a conductive material, such as copper, aluminum, or the like. The dielectric material 14 generally electrically insulates the inner conductor 12, and may include a polymer or the like. In some embodiments, the dielectric material 14 is generally elastic such that the dielectric material 14 to elastically deform under force, thereby allowing the coaxial cable 10 to bend.

In embodiments, the coaxial cable 10 further includes an outer conductor 16 surrounding the dielectric material 14. In some configurations, the outer conductor 16 may be maintained at a ground potential while electrical signals are transmitted through the inner conductor 12. The outer conductor 16 may be formed of a conductive material, such as aluminum foil, copper foil, or the like. In some embodiments, the coaxial cable 10 further includes an outer braid 18 positioned outwardly from and engaged with the outer conductor 16. In embodiments, the outer braid 18 may be formed of a conductive material, such as braided copper wire, braided aluminum wire or the like. In embodiments, the outer braid 18 may assist in shielding the inner conductor 12 of the coaxial cable 10.

The coaxial cable 10, in embodiments, further includes an outer jacket 20 surrounding at least a portion of the outer conductor 16 and/or the outer braid 18. The outer jacket 20 may be formed of a polymer or the like and may generally protect the coaxial cable 10 from environmental elements, such as moisture.

Figure 2A:
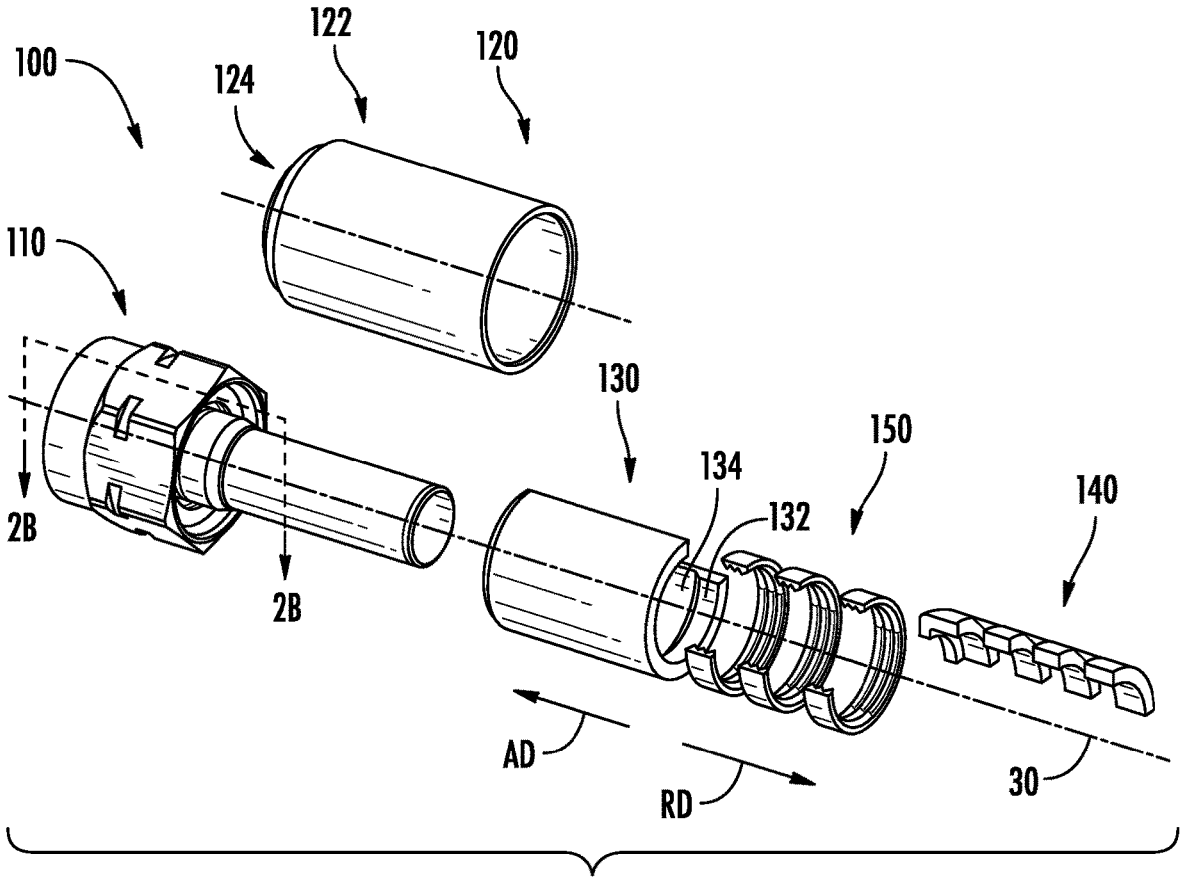
FIG. 2A schematically depicts an exploded view of a coaxial cable connector assembly, according to one or more embodiments shown and described herein.

Referring to FIG. 2A, an exploded view of a coaxial cable connector assembly 100 is schematically depicted. In embodiments, the coaxial cable connector assembly 100 extends in an axial direction, depicted in FIG. 2A as advancing direction AD, and retreating direction RD. The coaxial cable 10 (FIG. 1) can be inserted into the coaxial cable connector assembly 100 in the advancing direction AD, and is restricted from being removed from the coaxial cable connector assembly 100 along the retreating direction RD, as described in greater detail herein. The coaxial cable connector assembly 100 generally includes a coupler 110 and a rear body assembly 120 positioned rearward of the coupler 110. In embodiments, the coupler 110 and the rear body assembly 120 are rotatably engaged with one another, such that the coupler 110 may rotate about the rear body assembly 120, for example about the axial direction. The rear body assembly 120 can be coupled to the coaxial cable 10 (FIG. 1), thereby coupling the coaxial cable 10 (FIG. 1) to the coaxial cable connector assembly 100, as described in greater detail herein.

Figure 2B:
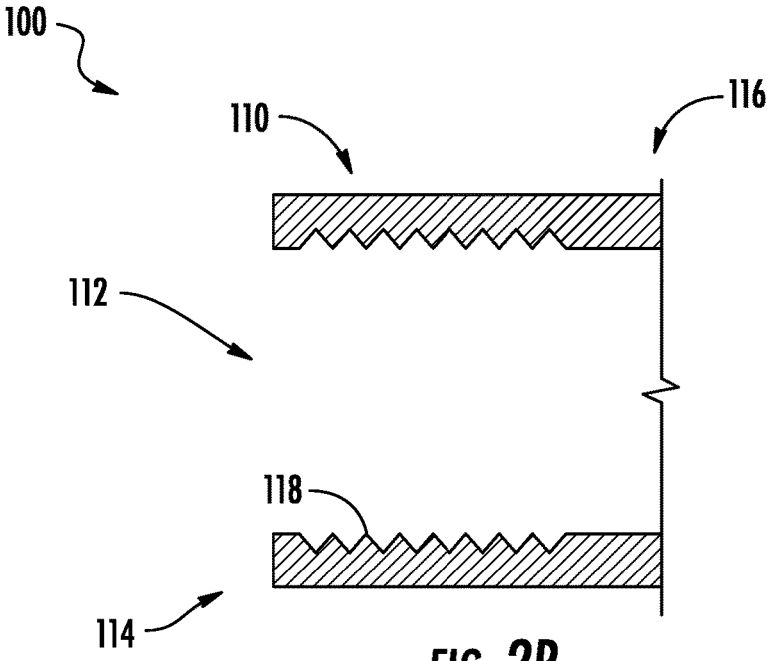
FIG. 2B schematically depicts a section view of the coaxial cable connector assembly along section 2B-2B of FIG. 2A, according to one or more embodiments shown and described herein.

Referring to FIG. 2B, an enlarged section view of the coupler 110 along section 2B-2B of FIG. 2A is schematically depicted. In embodiments, the coupler 110 defines an inner channel 112 extending between a front portion 114 of the coupler 110 and a rear portion 116 of the coupler 110 opposite the front portion 114. In embodiments, the coupler 110 defines a thread 118 at the front portion 114 of the coupler 110. The thread 118, in embodiments, is structurally configured to engage a corresponding thread of a port of a device, such as a television, a cable box, or the like, thereby coupling the coaxial cable connector assembly 100 to the port of the device. In some embodiments, the coupler 110 may be formed of a material suitable to conduct electricity, such as copper, brass, aluminum, or the like, and in embodiments, the coupler 110 is electrically coupled to the outer conductor 16 (FIG. 1) and/or the outer braid 18 (FIG. 1) of the coaxial cable 10 (FIG. 1).

Referring again to FIG. 2A, in embodiments, the rear body assembly 120 includes an outer housing 122, a stationary retention member 130, a movable retention member 140, and one or more compression rings 150. The outer housing 122 may include an annular-shaped member defining a housing channel 124 extending through the outer housing 122 in the axial direction. In embodiments, the stationary retention member 130, the movable retention member 140, and the one or more compression rings 150 may be inserted within the housing channel 124 of the outer housing 122. In some embodiments, the outer housing 122 of the rear body assembly 120 may include inwardly extending lips at a front portion and a rear portion of the rear body assembly 120. The inwardly extending lips may assist in retaining the stationary retention member 130, the movable retention member 140, and/or the one or more compression rings 150 within the outer housing 122 of the rear body assembly 120.

In embodiments, the stationary retention member 130 defines a stationary retention member inner channel surface 132 extending through the stationary retention member 130 in the axial direction. In embodiments, the stationary retention member 130 further defines one or more stationary retention member grooves 134 extending outwardly from the stationary retention member inner channel surface 132. As referred to herein, the terms "inward," "outward," "inwardly," "outwardly," and the like refer to the relative positioning of components with respect to a centerline 30 extending through the coaxial cable connector assembly 100 in the axial direction. Individual compression rings of the one or more compression rings 150 can be in inserted within individual grooves of the one or more stationary retention member grooves 134 of the stationary retention member 130. In the embodiment depicted in FIG. 2A, the stationary retention member 130 has an annular, c-shape, however, it should be understood that this is merely an example.

In embodiments, the one or more compression rings 150 are c-shaped and are structurally configured to be positioned at least partially within the one or more stationary retention member grooves 134 of the stationary retention member 130. In embodiments, the one or more compression rings 150 are axially inwardly and/or outwardly deformable, as described in greater detail herein. While in the embodiment depicted in FIG. 2A, the coaxial cable connector assembly 100 includes three compression rings 150, this is merely an example, and the coaxial cable connector assembly 100 can include any suitable number of compression rings 150.

Figure 3A:
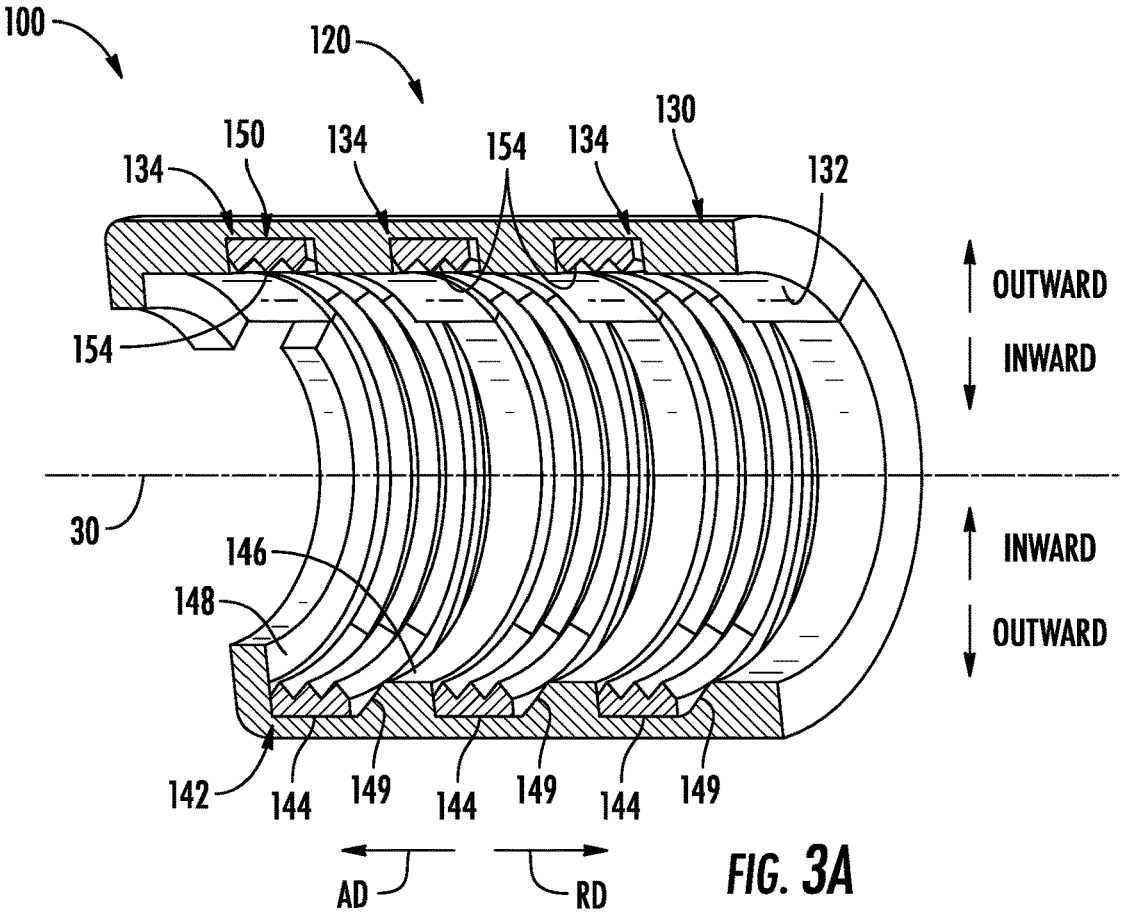
FIG. 3A schematically depicts a section view of the coaxial cable connector assembly of FIG. 2A, according to one or more embodiments shown and described herein.

Referring to FIG. 3A, a section view of the stationary retention member 130, the one or more compression rings 150, and the movable retention member 140 is schematically depicted. As shown in FIG. 3A, when assembled, the one or more compression rings 150 are positioned at least partially within the one or more stationary retention member grooves 134 of the stationary retention member 130.

In some embodiments, the one or more compression rings 150 may include one or more inwardly-extending teeth 154. The inwardly-extending teeth 154 are structurally configured to engage the outer jacket 20 (FIG. 1) of the coaxial cable 10 (FIG. 1) to couple the coaxial cable connector assembly 100 to the coaxial cable 10, as described in greater detail herein.

In embodiments, the movable retention member 140 is movable with respect to the stationary retention member 130 in the axial direction. For example, in some embodiments, the movable retention member 140 defines a cable engagement surface 148 structurally configured to engage the coaxial cable 10 (FIG. 1) as the coaxial cable 10 (FIG. 1) is inserted in to the coaxial cable connector assembly 100 in the advancing direction AD. In some embodiments, the cable engagement surface 148 is rearwardly-facing in the axial direction. As the coaxial cable 10 (FIG. 1) is inserted into the coaxial cable connector assembly 100 in the advancing direction AD, the coaxial cable 10 (FIG. 1) engages the cable engagement surface 148 of the movable retention member 140. With the coaxial cable 10 (FIG. 1) engaged with the cable engagement surface 148 of the movable retention member 140, the movable retention member 140 moves in the advancing direction AD with respect to the stationary retention member 130 as the coaxial cable 10 (FIG. 1) moves in the advancing direction AD.

In embodiments, the movable retention member 140 defines one or more movable retention member grooves 142 extending into the movable retention member 140. In particular, in embodiments, the movable retention member 140 defines a movable retention member inner channel surface 146, and the one or more movable retention member grooves 142 extend outwardly from the movable retention member inner channel surface 146. The one or more movable retention member grooves 142 each define a movable retention member groove surface 144, and a movable retention member tapered surface 149 extending between the movable retention member groove surface 144 and the movable retention member inner channel surface 146. In particular, the movable retention member tapered surface 149 extends inwardly from the movable retention member groove surface 144 to the movable retention member inner channel surface 146. Contact between the movable retention member tapered surface 149 and the one or more compression rings 150 repositions the compression rings 150 from a disengaged position, into an engaged position, as described in greater detail herein.

Figure 3B:
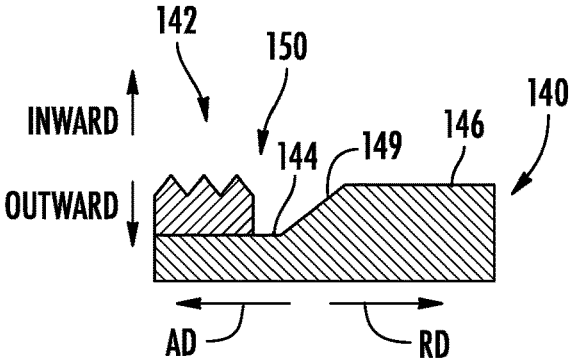
FIG. 3B schematically depicts an enlarged view of a compression ring and a movable retention member of the coaxial cable connector assembly of FIG. 2A in a disengaged position, according to one or more embodiments shown and described herein.

For example and referring to FIG. 3B, an enlarged section view of one of the one or more compression rings 150 and the movable retention member 140 is schematically depicted in the disengaged position. While in the embodiment depicted in FIG. 3B a single compression ring 150 and a single movable retention member groove 142 are depicted, each of the compression rings 150 and the movable retention member grooves 142 of the movable retention member 140 may be similarly positioned in the disengaged position. In the disengaged position, the one or more compression rings 150 are positioned within the one or more movable retention member grooves 142, and more particularly, are engaged with the movable retention member groove surface 144.

Figure 3C:
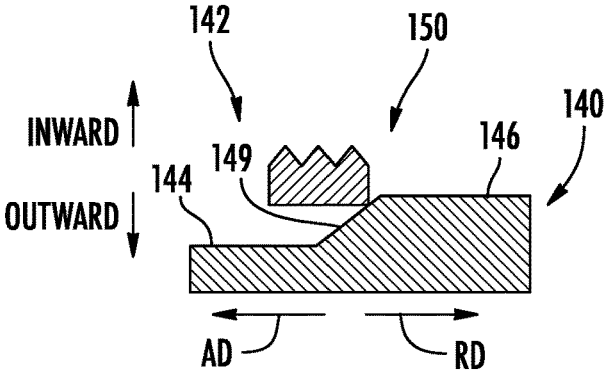
FIG. 3C schematically depicts an enlarged view of the compression ring and the movable retention member of FIG. 3B in an engaged position, according to one or more embodiments shown and described herein.

In embodiments, moving the movable retention member 140 in the axial direction (i.e., in the advancing direction AD) repositions the movable retention member 140 and the one or more compression rings 150 from the disengaged position, as shown in FIG. 3B, into an engaged position shown in FIG. 3C. In particular and referring to FIGS. 3A and 3C, the movable retention member 140 can be moved with respect to the stationary retention member 130 in the advancing direction AD as the coaxial cable 10 (FIG. 1) is inserted into the coaxial cable connector assembly 100 in the advancing direction AD and contacts the cable engagement surface 148.

As noted above, the one or more compression rings 150 are positioned at least partially within the stationary retention member grooves 134. Engagement between the one or more compression rings 150 and the stationary retention member grooves 134 restricts axial movement of the one or more compression rings 150 with respect to the stationary retention member 130. Accordingly, as the movable retention member 140 moves with respect to the stationary retention member 130 in the advancing direction AD, the movable retention member 140 moves with respect to the one or more compression rings 150 in the advancing direction AD. As the movable retention member 140 moves in the advancing direction AD, the one or more compression rings 150 engage the movable retention member tapered surface 149 of the movable retention member 140. Engagement with the movable retention member tapered surface 149 inwardly deforms the one or more compression rings 150, thereby moving the one or more compression rings 150 into the engaged position. In some embodiments, the one or more compression rings 150 are at least partially engaged with the movable retention member tapered surface 149 of the movable retention member 140 in the engaged position. In some embodiments, the one or more compression rings 150 are at least partially engaged with the movable retention member inner channel surface 146 of the movable retention member 140.

Figure 4A:
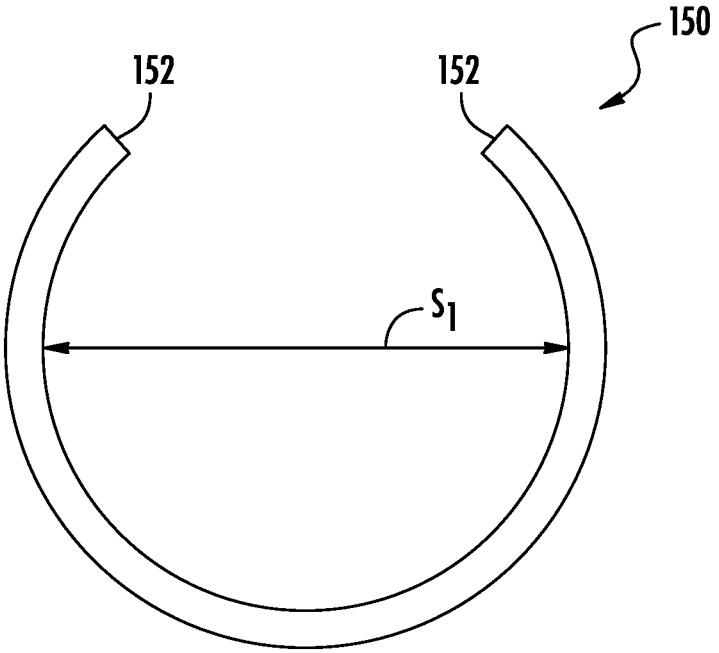
FIG. 4A schematically depicts the compression ring of FIG. 3B in the disengaged position, according to one or more embodiments shown and described herein.
Figure 4B:
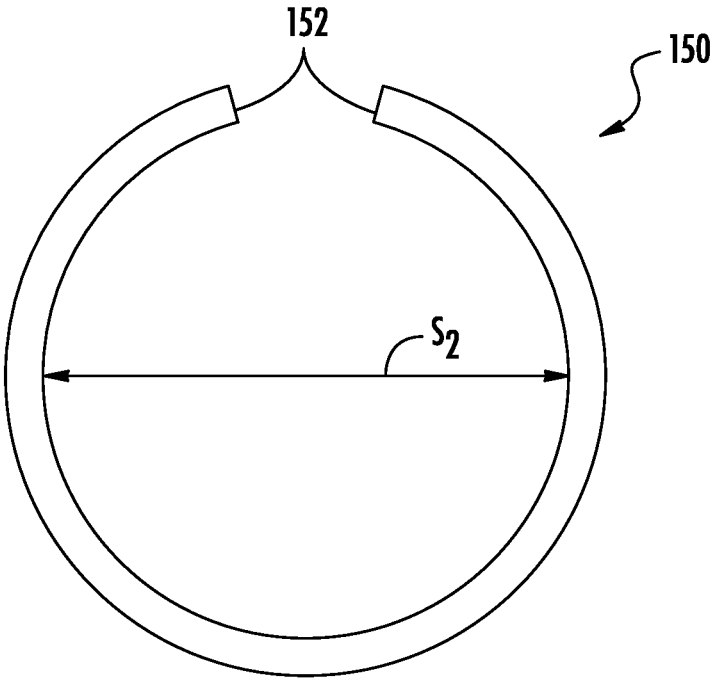
FIG. 4B schematically depicts the compression ring of FIG. 4B in the engaged position, according to one or more embodiments shown and described herein.

As the one or more compression rings 150 deform inwardly, the one or more compression rings 150 can be moved into engagement with the outer jacket 20 (FIG. 1) of the coaxial cable 10 (FIG. 1). For example and referring to FIGS. 4A and 4B, a front view of one of the one or more compression rings 150 is depicted in the disengaged position and the engaged position, respectively. In the disengaged position shown in FIG. 4A, the one or more compression rings 150 define a disengaged inner span S1. In the engaged position shown in FIG. 4B, the one or more compression rings 150 define an engaged inner span S2, where the engaged inner span S2 is less than the disengaged inner span S1.

By inwardly deforming and decreasing the inner span of the one or more compression rings 150, the one or more compression rings 150 can be brought into contact with the outer jacket 20 (FIG. 1) of the coaxial cable 10 (FIG. 1). For example, the inwardly-extending teeth 154 (FIG. 3A) of the one or more compression rings 150 can engage the outer jacket 20 (FIG. 1) of the coaxial cable 10 (FIG. 1). Engagement between the one or more compression rings 150 and the outer jacket 20 (FIG. 1) of the coaxial cable 10 (FIG. 1) restricts axial movement of the coaxial cable 10 with respect to the one or more compression rings 150. As noted above, because the one or more compression rings 150 are positioned at least partially within the one or more stationary retention member grooves 134, axial movement of the one or more compression rings 150 with respect to the stationary retention member 130 is restricted. Accordingly, engagement of the outer jacket 20 (FIG. 1) of the coaxial cable 10 (FIG. 1) with the one or more compression rings 150 restricts axial movement of the coaxial cable 10 (FIG. 1) with respect to the stationary retention member 130. In this way, the coaxial cable 10 (FIG. 1) can be coupled to the coaxial cable connector assembly 100.

Figure 5A:
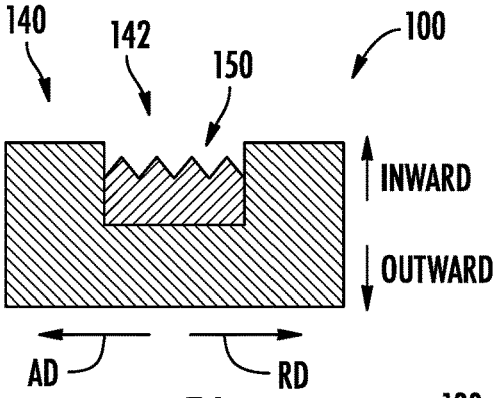
FIG. 5A schematically depicts an enlarged section view of another movable retention member and compression ring in a disengaged position, according to one or more embodiments shown and described herein.
Figure 5B:
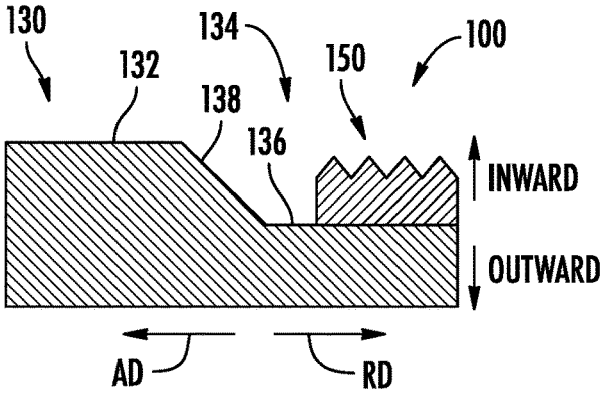
FIG. 5B schematically an enlarged section view of another stationary retention member and compression ring in the disengaged position, according to one or more embodiments shown and described herein.

Referring to FIGS. 5A and 5B, another embodiment of the coaxial cable connector assembly 100 is depicted in the disengaged position. In particular, FIG. 5A schematically depicts a section view of another movable retention member 140 in the disengaged position, and FIG. 5B schematically depicts a section view of another stationary retention member 130 in the disengaged position. Similar to the embodiments described above and depicted in FIGS. 3A-3C, the movable retention member 140 includes one or more movable retention member grooves 142, and the stationary retention member 130 includes one or more stationary retention member grooves 134. However, in the embodiment depicted in FIGS. 5A and 5B, the one or more stationary retention member grooves 134 includes a stationary retention member groove surface 136 and a stationary retention member tapered surface 138. For example, the stationary retention member groove 134 includes the stationary retention member groove surface 136 positioned outward from the stationary retention member inner channel surface 132, and the stationary retention member tapered surface 138 extends between the stationary retention member groove surface 136 and the stationary retention member inner channel surface 132.

In the disengaged position shown in FIGS. 5A and 5B, the one or more compression rings 150 are positioned at least partially within the one or more movable retention member grooves 142 of the movable retention member 140 and the one or more stationary retention member grooves 134 of the stationary retention member 130. As shown in FIG. 5B, the one or more compression rings 150 are engaged with the stationary retention member groove surface 136 in the disengaged position.

As the coaxial cable 10 (FIG. 1) is inserted into the coaxial cable connector assembly 100 in the advancing direction AD, the coaxial cable 10 (FIG. 1) moves the movable retention member 140 in the advancing direction AD, for example through engagement with the cable engagement surface 148 (FIG. 3A). Similar to the embodiment described above and depicted in FIGS. 3A-3C, movement of the movable retention member 140 in the advancing direction AD. However, in the embodiment depicted in FIGS. 5A and 5B, as the movable retention member 140 moves in the advancing direction, the one or more compression rings 150 move in the advancing direction AD. For example and referring to FIG. 5A, in some embodiments, one or more movable retention member grooves 142 may restrict axial movement of the one or more compression rings 150 with respect to the movable retention member 140. Accordingly, the one or more compression rings 150 may move in the advancing direction AD as the movable retention member 140 moves in the advancing direction AD.

Figure 6A:
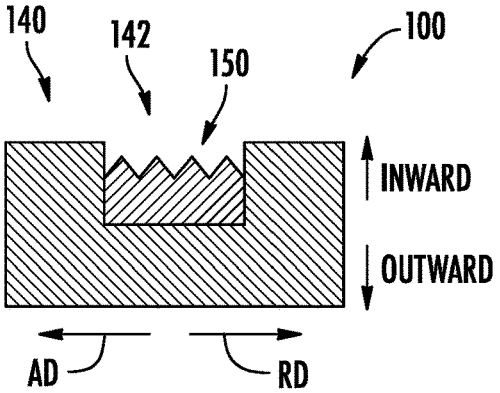
FIG. 6A schematically depicts the compression ring and movable retention member of FIG. 5A in the engaged position, according to one or more embodiments shown and described herein.
Figure 6B:
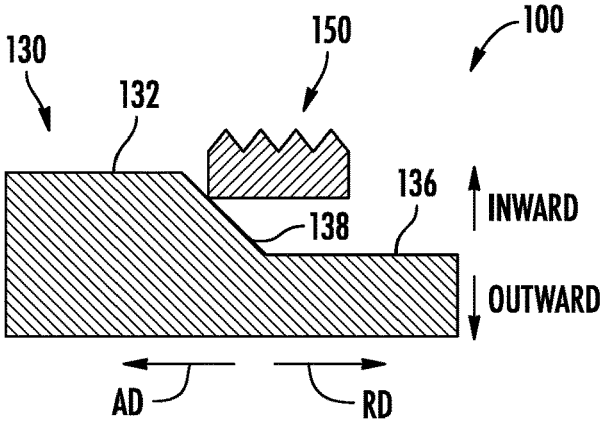
FIG. 6B schematically depicts the compression ring and stationary retention member of FIG. 5B in the engaged position, according to one or more embodiments shown and described herein.

As the movable retention member 140 and the one or more compression rings 150 move in the advancing direction AD, the movable retention member 140 and the one or more compression rings 150 are moved to the engaged position, as depicted in FIGS. 6A and 6B. In particular, as the movable retention member 140 and the one or more compression rings 150 move in the advancing direction AD, the one or more compression rings 150 engage the stationary retention member tapered surface 138. Engagement with the stationary retention member tapered surface 138 inwardly deforms the one or more compression rings 150 such that the one or more compression rings 150 may engage the outer jacket 20 (FIG. 1) of the coaxial cable 10 (FIG. 1), similar to the embodiment described above and depicted in FIGS. 3A-3C. In some embodiments, the one or more compression rings 150 may be at least partially engaged with the stationary retention member tapered surface 138 in the engaged position. In some embodiments, the one or more compression rings 150 may be at least partially engaged with the stationary retention member inner channel surface 132 in the engaged position. While the section views depicted in FIGS. 5A-6B depict section views of a single compression ring 150, it should be understood that in embodiments, each of the compression rings 150 of the coaxial cable connector assembly 100 may be similarly engaged with the movable retention member 140 and the stationary retention member 130.

Figure 7:
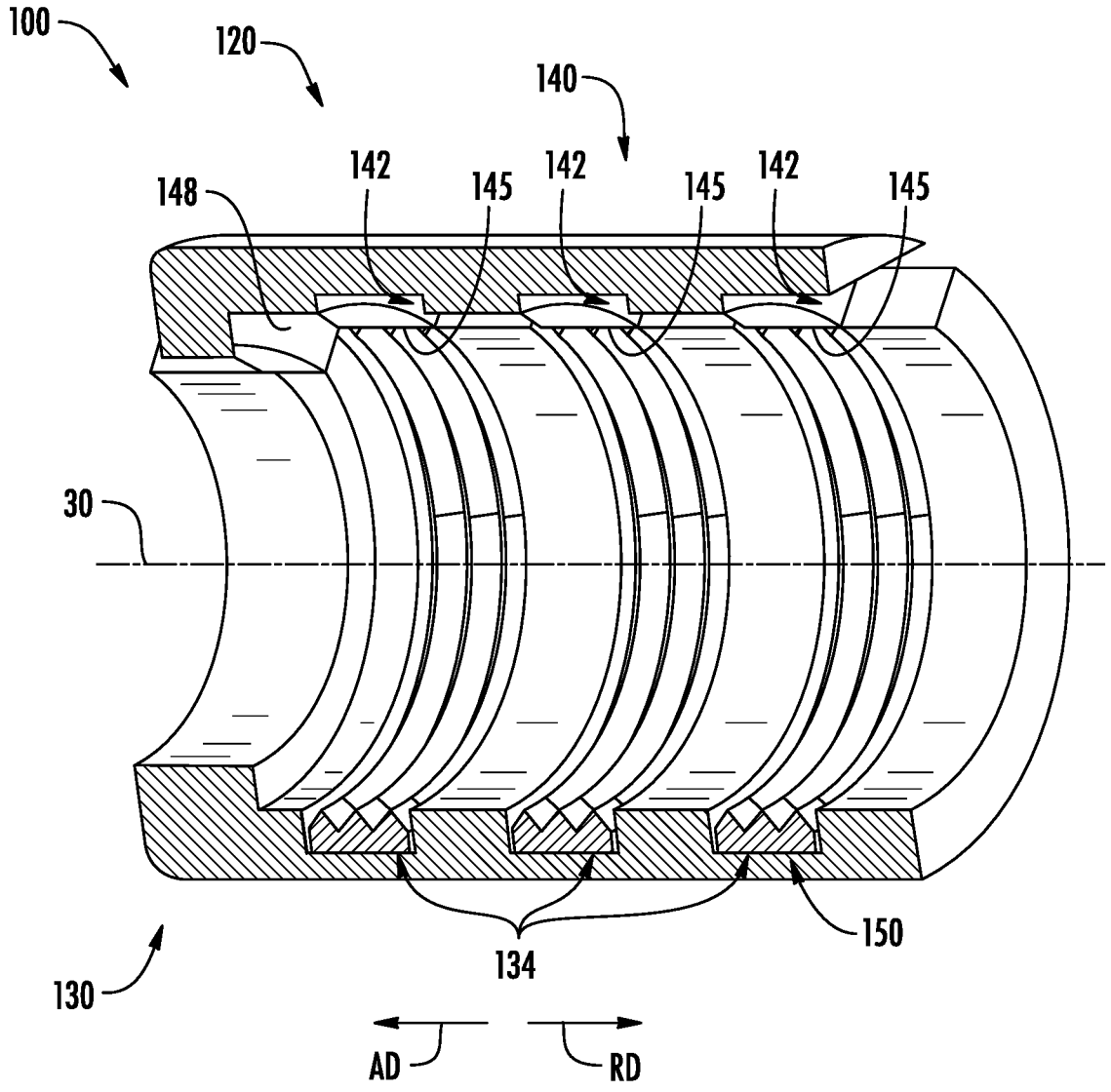
FIG. 7 schematically depicts a section view of another coaxial cable connector assembly, according to one or more embodiments shown and described herein.

Referring to FIG. 7, a section view of another embodiment of a coaxial cable connector assembly 100 is schematically depicted. Similar to the embodiments described above, the coaxial cable connector assembly 100 includes the movable retention member 140, the stationary retention member 130, and the one or more compression rings 150. The movable retention member 140 includes the cable engagement surface 148, and in embodiments, the coaxial cable 10 (FIG. 1) can move the movable retention member 140 in the advancing direction AD with respect to the stationary retention member 130 through engagement with the cable engagement surface 148.

However, in the embodiment depicted in FIG. 7, the movable retention member 140 defines a compression ring engagement face 145 that is engageable with the one or more compression rings 150. For example and referring to FIGS. 7 and 8A, a top view of the coaxial cable connector assembly 100 is schematically depicted with the movable retention member 140 and the one or more compression rings 150 positioned in the disengaged position. In the disengaged position, the compression ring engagement face 145 of the movable retention member 140 is engaged with the one or more compression rings 150. In some embodiments, the compression ring engagement face 145 is a first compression ring engagement face 145, and the movable retention member 140 further includes a second compression ring engagement face 147. The first compression ring engagement face 145 and the second compression ring engagement face 147 can engage end faces 152 of the one or more compression rings 150 and retain the one or more compression rings 150 in a disengaged position. For example, in embodiments in which the one or more compression rings 150 include the c-shape, the first compression ring engagement face 145 and the second compression ring engagement face 147 may engage end faces 152 (FIGS. 4A, 4B) of the one or more compression rings 150. Through engagement with the end faces 152 (FIGS. 4A, 4B) of the one or more compression rings 150, the movable retention member 140 may outwardly deform the one or more compression rings 150.

Figure 8A:
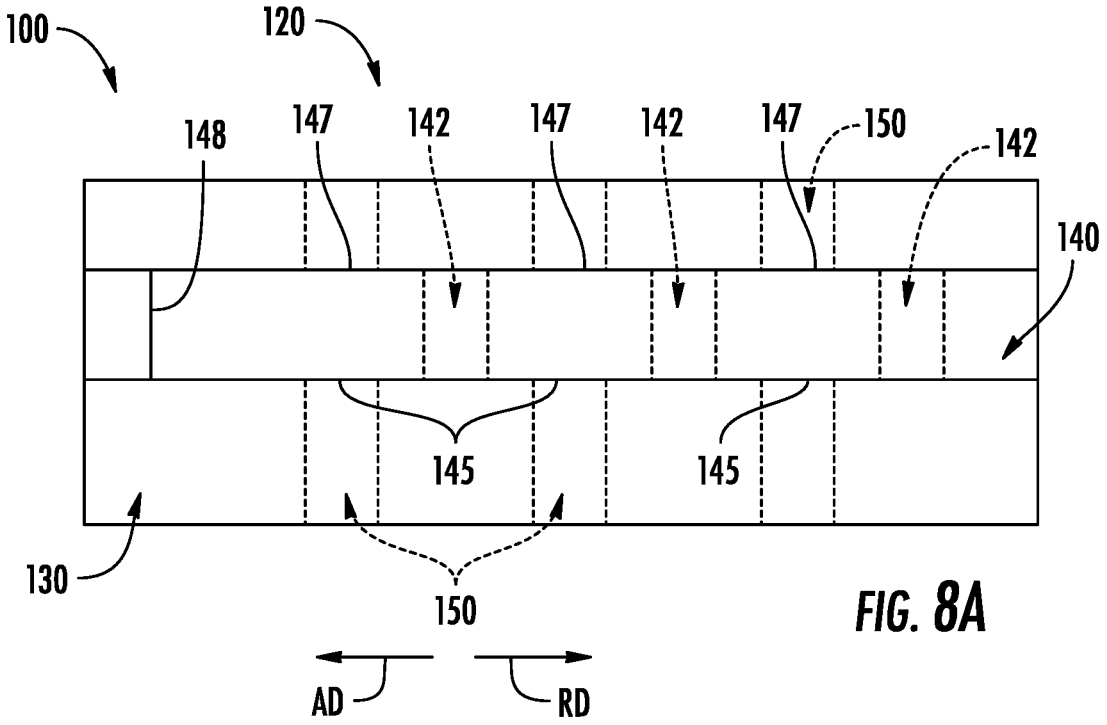
FIG. 8A schematically depicts a top view of the coaxial cable connector assembly of FIG. 7 in the disengaged position, according to one or more embodiments shown and described herein.

As shown in FIGS. 7 and 8A, in the disengaged position, the movable retention member grooves 142 are axially offset from the one or more compression rings 150 in the disengaged position. For example, in embodiments, the movable retention member grooves 142 are positioned rearward of the one or more compression rings 150 in the advancing direction AD in the disengaged position.

Figure 8B:
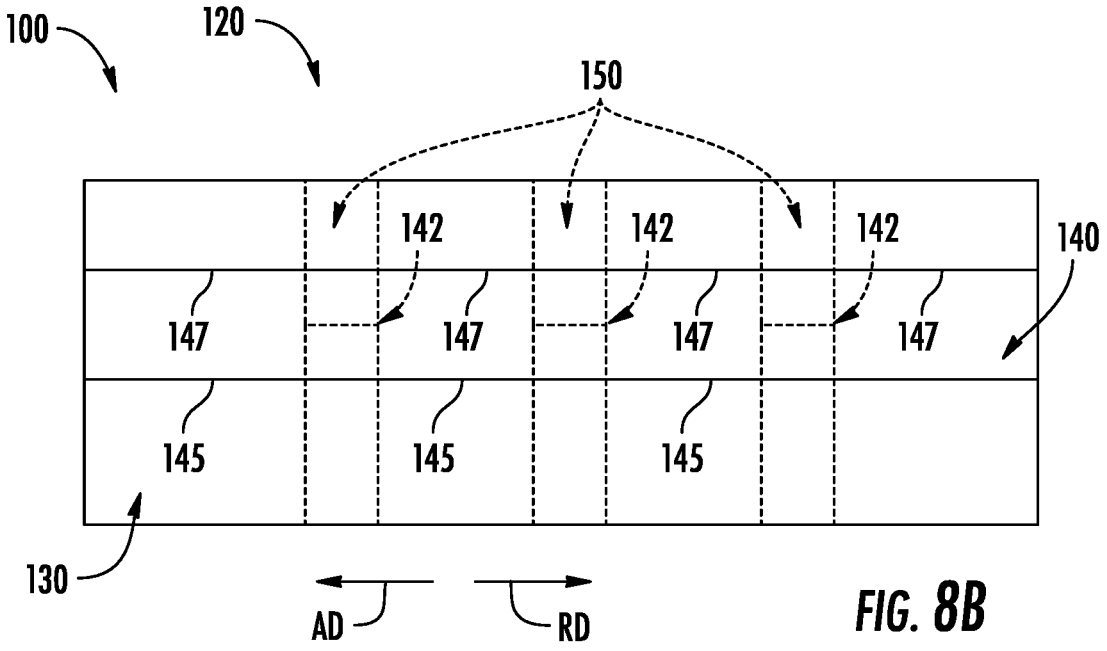
FIG. 8B schematically depicts a top view of the coaxial cable connector assembly of FIG. 7 in the engaged position, according to one or more embodiments shown and described herein.

As the movable retention member 140 moves in the advancing direction AD, for example through engagement with the coaxial cable 10 (FIG. 1) as the coaxial cable 10 (FIG. 1) is inserted into the coaxial cable connector assembly 100 in the advancing direction AD. Referring to FIGS. 7 and 8B, a top view of the movable retention member 140 and the one or more compression rings 150 is depicted in the engaged position. In the engaged position, the first compression ring engagement face 145 and/or the second compression ring engagement face 147 are spaced apart from the one or more compression rings 150 in the axial direction. For example, as the movable retention member 140 moves in the advancing direction AD, the first compression ring engagement face 145 and/or the second compression ring engagement face 147 disengage the one or more compression rings 150. Further, as the movable retention member 140 moves in the advancing direction AD, the movable retention member grooves 142 may be aligned with the one or more compression rings 150, releasing the one or more compression rings 150 into the engaged position. Similar to the embodiments described above, in the engaged position, the one or more compression rings 150 may engage the outer jacket 20 (FIG. 1) of the coaxial cable 10 (FIG. 1) such that movement of the coaxial cable 10 (FIG. 1) with respect to the coaxial cable connector assembly 100 is restricted in the retreating direction RD.

Accordingly, it should now be understood that embodiments described herein are directed to coaxial cable connector assemblies including retention members that can be coupled to a coaxial cable. Coaxial cable connector assemblies, according to embodiments described herein generally include a rear body assembly including one or more compression rings that can be moved from a disengaged position to an engaged position as the coaxial cable is inserted into the coaxial cable connector assembly. The one or more compression rings may engage the coaxial cable in the engaged position, thereby coupling the coaxial cable to the coaxial cable connector assembly having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A coaxial cable connector assembly comprising:

a coupler;

a rear body assembly rotatably engaged with the coupler, the rear body assembly comprising:

a stationary retention member defining an stationary retention member inner channel surface and one or more stationary retention member grooves extending inwardly from the stationary retention member inner channel surface;

a movable retention member that is movable with respect to the stationary retention member in an axial direction, the movable retention member defining a movable retention member inner channel surface and one or more movable retention member grooves extending inwardly from the movable retention member inner channel surface, the one or more movable retention member grooves defining a movable retention member groove surface; and one or more compression rings positioned at least partially within the one or more stationary retention member grooves.

2. The coaxial cable connector assembly of claim 1, wherein the coupler comprises a thread at a front portion of the coupler structurally configured to couple the coaxial cable connector assembly to a port of a device.

3. The coaxial cable connector assembly of claim 1, wherein the movable retention member comprises a cable engagement surface structurally configured to engage a coaxial cable inserted into the coaxial cable connector assembly in an advancing direction.

4. The coaxial cable connector assembly of claim 1, wherein the one or more compression rings are positionable between a first engaged position, in which the one or more compression rings define an engaged inner span, and a first disengaged position, in which the one or more compression rings define a disengaged inner span, and wherein the engaged inner span has an engaged inner span dimension less than a disengaged inner span dimension.

5. The coaxial cable connector assembly of claim 4, wherein the movable retention member is positionable from second disengaged position, in which the movable retention member retains the one or more compression rings to a second engaged position, in which the movable retention member releases the one or more compression rings into the engaged position.

6. The coaxial cable connector assembly of claim 4, wherein the movable retention member defines a compression ring engagement face, and wherein the movable retention member is positionable from a second disengaged position, in which the compression ring engagement face is engaged with the one or more compression rings, to another engaged position in which the compression ring engagement face is spaced apart from the one or more compression rings.

7. The coaxial cable connector assembly of claim 1, wherein the movable retention member defines a movable retention member tapered surface extending between the movable retention member inner channel surface and the movable retention member groove surface.

8. The coaxial cable connector assembly of claim 7, wherein the movable retention member is positionable from a disengaged position, in which the one or more compression rings are engaged with the movable retention member groove surface, to an engaged position, in which the one or more compression rings are engaged with the movable retention member tapered surface.

9. The coaxial cable connector assembly of claim 1, wherein the one or more stationary retention member grooves define a stationary retention member groove surface positioned outwardly with respect to the stationary retention member inner channel surface of the stationary retention member and a stationary retention member tapered surface extending between the stationary retention member inner channel surface and the stationary retention member groove surface.

10. The coaxial cable connector assembly of claim 9, wherein the movable retention member is positionable from a disengaged position, in which the one or more compression rings are engaged with the stationary retention member groove surface, to an engaged position, in which the movable retention member moves the one or more compression rings to engage the stationary retention member tapered surface.

11. The coaxial cable connector assembly of claim 1, wherein the one or more compression rings define a c-shape.

12. The coaxial cable connector assembly of claim 1, wherein the one or more compression rings include one or more inwardly-extending teeth structurally configured to engage an outer jacket of a coaxial cable to couple the coaxial cable connector assembly to the coaxial cable.

13. The coaxial cable connector assembly of claim 1, wherein the rear body assembly further comprises an outer housing defining a housing channel, and wherein the movable retention member and the stationary retention member are positioned at least partially within the housing channel of the outer housing.

14. A method for coupling a coaxial cable to a coaxial cable connector assembly, comprising:

inserting the coaxial cable into a rear body assembly of the coaxial cable connector assembly, the coaxial cable comprising an inner conductor and an outer jacket surrounding the inner conductor, and wherein the coaxial cable connector assembly comprises the rear body assembly and a coupler rotatably engaged with the rear body assembly;

engaging a movable retention member of the rear body assembly with the coaxial cable;

moving the movable retention member in an advancing direction with respect to a stationary retention member of the rear body assembly, the stationary retention member defining a stationary retention member inner channel surface and one or more stationary retention member grooves extending inwardly from the stationary retention member inner channel surface, and the rear body assembly further comprising one or more compression rings positioned at least partially within the one or more stationary retention member grooves; and engaging the outer jacket of the coaxial cable with the one or more compression rings, thereby coupling the coaxial cable to the coaxial cable connector assembly.

15. The method of claim 14, wherein engaging the outer jacket of the coaxial cable with the one or more compression rings comprises engaging at least one of a movable retention member tapered surface of the movable retention member and a stationary retention member tapered surface of the stationary retention member with the one or more compression rings.

16. The method of claim 15, wherein engaging the outer jacket of the coaxial cable with the one or more compression rings comprises engaging the movable retention member tapered surface of the movable retention member with the one or more compression rings.

17. The method of claim 14, wherein engaging the outer jacket of the coaxial cable with the one or more compression rings comprises disengaging a compression ring engagement face of the movable retention member from the one or more compression rings.

18. The method of claim 14, wherein engaging the outer jacket of the coaxial cable with the one or more compression rings comprises engaging inwardly-facing teeth of the one or more compression rings with the outer jacket of the coaxial cable.

19. The method of any one of claim 14, wherein engaging the movable retention member with the coaxial cable comprises engaging the coaxial cable with a cable engagement surface of the movable retention member.

20. The method of claim 14, further comprising engaging a thread of the coupler of the coaxial cable connector assembly with a corresponding thread of a port device.

* * * * *